US011384973B2

(12) United States Patent
Jeong et al.

(10) Patent No.: US 11,384,973 B2
(45) Date of Patent: Jul. 12, 2022

(54) REFRIGERATOR

(71) Applicant: Samsung Electronics Co., Ltd., Suwon-si (KR)

(72) Inventors: Jin Jeong, Yongin-si (KR); Bong Su Son, Cheonan-si (KR); Do Yun Jang, Suwon-si (KR); Kook Jeong Seo, Seoul (KR); Moo Hyung Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/851,803

(22) Filed: Apr. 17, 2020

(65) Prior Publication Data

US 2020/0240697 A1 Jul. 30, 2020

Related U.S. Application Data

(63) Continuation of application No. 15/830,666, filed on Dec. 4, 2017, now Pat. No. 10,663,207.

(30) Foreign Application Priority Data

Dec. 8, 2016 (KR) ..... 10-2016-0166316

(51) Int. Cl.
*F25C 5/20* (2018.01)
*F25D 11/02* (2006.01)
(Continued)

(52) U.S. Cl.
CPC ..... *F25C 5/22* (2018.01); *F25C 5/24* (2018.01); *F25D 11/02* (2013.01); *F25D 17/06* (2013.01); *F25D 17/065* (2013.01); *F25D 23/04* (2013.01)

(58) Field of Classification Search
CPC .... F25C 5/22; F25C 5/24; F25D 11/02; F25D 17/065; F25D 23/04; F25D 17/06
See application file for complete search history.

(56) References Cited

U.S. PATENT DOCUMENTS 5,694,779 A 12/1997 Matsushima et al.
2004/0237565 A1 12/2004 Lee et al.
(Continued)

FOREIGN PATENT DOCUMENTS

CN 1573269 A 2/2005
CN 101074820 A 11/2007
(Continued)

OTHER PUBLICATIONS

The First Office Action in connection with Chinese Application No. 201711283637.6 dated Oct. 14, 2019, 18 pages.
(Continued)

*Primary Examiner* — Elizabeth J Martin

(57) ABSTRACT

A refrigerator that includes a main body, a wall and a storage compartment. The refrigerator further includes a door rotatably coupled to the main body configured to open and close the storage compartment. The door includes an ice-making chamber formed in a front surface of the door. The refrigerator also includes a cooling chamber that includes a cooler is provided inside the wall and configured to generate cooling air. The refrigerator also includes a cooling air duct configured to connect the ice-making chamber and the cooling chamber to supply the cooling air generated by the cooler to the ice-making chamber.

15 Claims, 9 Drawing Sheets

(51) Int. Cl.
*F25D 23/04* (2006.01)
*F25D 17/06* (2006.01)

(56) References Cited

U.S. PATENT DOCUMENTS

| | | | | |
|---|---|---|---|---|
| 2008/0127670 | A1 | 6/2008 | Tikhonov et al. | |
| 2008/0148761 | A1 | 6/2008 | Venkatakrishnan et al. | |
| 2010/0050680 | A1* | 3/2010 | Venkatakrishnan .. | F25D 17/065 62/340 |
| 2011/0011118 | A1 | 1/2011 | Cho et al. | |
| 2011/0239687 | A1* | 10/2011 | Lim ..... | F25D 23/025 62/344 |
| 2012/0096872 | A1* | 4/2012 | Cheong ..... | F25D 23/025 62/3.3 |
| 2014/0285082 | A1* | 9/2014 | Choi ..... | F25D 25/024 312/404 |
| 2016/0370048 | A1 | 12/2016 | Koo | |

FOREIGN PATENT DOCUMENTS

| | | | |
|---|---|---|---|
| CN | 101191690 | A | 6/2008 |
| CN | 101231099 | A | 7/2008 |
| CN | 102213517 | A | 10/2011 |
| CN | 102455108 | A | 5/2012 |
| CN | 102472550 | A | 5/2012 |
| CN | 105698460 | A | 6/2016 |
| EP | 1482263 | A2 | 12/2004 |
| EP | 1930671 | A1 | 6/2008 |
| EP | 2375200 | A1 | 10/2011 |
| EP | 3211354 | A2 | 8/2017 |
| KR | 10-0591305 | B1 | 6/2006 |
| KR | 10-2010-0110118 | A | 10/2010 |
| KR | 10-2015-0131715 | A | 11/2015 |
| KR | 10-1659913 | B1 | 9/2016 |
| WO | 2011007960 | A2 | 1/2011 |
| WO | 2011081499 | A2 | 7/2011 |

OTHER PUBLICATIONS

European Search Report in connection with European Application No. 18210549.4 dated Feb. 26, 2019, 7 pages.

Communication under Rule 71(3) EPC in connection with European Patent Application No. 17205279.7 dated Oct. 31, 2018, 32 pages.

European Search Report in connection with European Patent Application No. 17205279 dated Apr. 16, 2018.

National Intellectual Property Administration of the People's Republic of China, "The Third Office Action", dated Feb. 3, 2021 in connection with Chinese Patent Application No. 201711283637.6, 17 pages.

European Patent Office, "Communication pursuant to Article 94(3) EPC", dated Mar. 4, 2021, in connection with European Patent Application No. 18210549.4, 6 pages.

The Fourth Office Action dated Aug. 31, 2021, in connection with Chinese Application No. 201711283637.6, 16 pages.

* cited by examiner

REFRIGERATOR

CROSS-REFERENCE TO RELATED APPLICATIONS

This application is a continuation of application Ser. No. 15/830,666, filed Dec. 4, 2017, which claims priority to Korean Patent Application No. 10-2016-0166316, filed Dec. 8, 2016, the contents of which are incorporated herein by reference.

BACKGROUND

1. Field

Embodiments of the present disclosure relate to a refrigerator in which an ice-making chamber is provided.

2. Description of Related Art

A refrigerator is a home appliance including a main body having storage compartments, a cooling air supply provided to supply cooling air to the storage compartments, and doors provided to open and close the storage compartments and configured to maintain the freshness of food stored therein.

The refrigerator may also include an ice-making chamber for making and storing ice, and in the case of a bottom mounted freezer (BMF) type refrigerator, an ice-making chamber is provided at one corner inside a refrigerator compartment, or at a rear surface of a refrigerator compartment door.

An ice maker for making ice and an ice bucket configured to store the ice made by the ice maker and transfer the ice to a dispenser are disposed in the ice-making chamber, and in the case in which the ice-making chamber is provided inside the refrigerator compartment or on the rear surface of the refrigerator compartment door, the door should be opened such that the ice maker and the ice bucket disposed in the ice-making chamber are accessed.

SUMMARY

To address the above-discussed deficiencies, it is a primary object to provide a refrigerator of which an ice-making chamber is easily accessible.

It is another aspect of the present disclosure to provide a refrigerator in which leakage of cooling air is prevented when the ice-making chamber is accessed.

It is still another aspect of the present disclosure to provide a refrigerator in which space utilization of a storage compartment increases.

It is yet another aspect of the present disclosure to provide a refrigerator in which a storage compartment configured to store food and an ice-making chamber configured to make and store ice are separated from each other and thus a flow of cooling air between the storage compartment and the ice-making chamber is blocked.

It is yet another aspect of the present disclosure to provide a refrigerator in which ice making efficiency is improved.

Additional aspects of the disclosure will be set forth in part in the description which follows and, in part, will be appreciated from the description.

In accordance with one aspect of the present disclosure, a refrigerator includes: a main body including a wall and a storage compartment formed by the wall; a door rotatably coupled to the main body to open and close the storage compartment, and including an ice-making chamber formed in a front surface of the door to be separated from the storage compartment; a cooling chamber in which a cooler provided inside the wall and configured to generate cooling air is disposed; and a cooling air duct configured to connect the ice-making chamber and the cooling chamber to supply the cooling air generated by the cooler to the ice-making chamber.

The wall may include an inner box, an outer box, and an insulation provided between the inner box and the outer box and further include a cooling chamber case buried in the insulation and including the cooling chamber formed thereinside.

The refrigerator may further include an auxiliary door provided to open and close the ice-making chamber, wherein the ice-making chamber may be accessible by opening the auxiliary door in a state in which the door is closed.

An auxiliary door may be rotatably coupled to the door in a direction different from a rotational direction of the door.

An auxiliary door may be rotatable in the same as a rotational direction of the door and cover an entire front surface of the door.

The cooling air duct may include a supply duct provided to supply cooling air of the cooling chamber to the ice-making chamber, and a collecting duct provided such that air of the ice-making chamber is collected in the cooling chamber.

The supply duct may include a main body supply duct provided in the main body and a door supply duct provided in the door, and the main body supply duct and the door supply duct may be connected to each other when the door is closed, and separated from each other when the door is opened.

An inlet of the main body supply duct may be connected to the cooling chamber, an outlet of the door supply duct may be connected to the ice-making chamber, and an outlet of the main body supply duct and an inlet of the door supply duct may be provided to be connected to each other when the door is closed.

The collecting duct may include a main body collecting duct provided in the main body and a door collecting duct provided in the door, and the main body collecting duct and the door collecting duct may be connected to each other when the door is closed and separated from each other when the door is opened.

An inlet of the door collecting duct may be connected to the ice-making chamber, an outlet of the main body collecting duct may be connected to the cooling chamber, and an outlet of the door collecting duct and an inlet of the main body collecting duct may be connected to each other when the door is closed.

The refrigerator may further include an ice maker disposed in the ice-making chamber and configured to make ice, and an ice bucket disposed in the ice-making chamber and configured to store the ice generated by the ice maker.

The door may include a dispenser configured to supply ice stored in the ice bucket to the outside, and the ice bucket may include a mover configured to transfer ice to the dispenser.

The refrigerator may further include a blower fan disposed in the cooling chamber and configured to circulate cooling air between the ice-making chamber and the cooling chamber through the cooling air duct.

The cooler may include at least any one of a vaporizer and a thermoelement.

In accordance with another aspect of the present disclosure, a refrigerator includes: a main body including an upper wall, a bottom wall, a rear wall, a left side wall, a right side wall, and an intermediate wall provided between the upper wall and the bottom wall; a refrigerator compartment formed between the upper wall and the intermediate wall; a freezer compartment formed between the intermediate wall and the bottom wall; a refrigerator compartment door provided to open and close the refrigerator compartment; a freezer compartment door provided to open and close the freezer compartment; an ice-making chamber formed in a front surface of the refrigerator compartment door to be separated from the refrigerator compartment; a cooling chamber provided in the main body, wherein an ice-making chamber cooler is disposed in the cooling chamber to cool the ice-making chamber; a cooling air duct provided to connect the cooling chamber and the ice-making chamber; and a blower fan provided such that cooling air of the cooling chamber flows to the ice-making chamber through the cooling air duct.

The cooling chamber may be provided inside any one among the intermediate wall, the rear wall, the upper wall, the left side wall, and the right side wall.

The refrigerator may further include a refrigerator compartment cooler provided to cool the refrigerator compartment, and a freezer compartment cooler provided to cool the freezer compartment, wherein the ice-making chamber may be cooled independently of the refrigerator compartment and the freezer compartment.

In accordance with still another aspect of the present disclosure, a refrigerator includes: a main body including a refrigerator compartment and a freezer compartment; a door configured to open and close the refrigerator compartment and including an ice-making chamber formed in a front surface of the door to be separated from the refrigerator compartment; a connecting duct configured to connect the ice-making chamber and the freezer compartment; and a thermoelement including a cooling portion configured to absorb heat and a heating portion configured to dissipate the heat, and disposed in the connecting duct to dissipate heat of the ice-making chamber to the freezer compartment to cool the ice-making chamber.

The thermoelement may be disposed adjacent to the freezer compartment such that the cooling portion faces the connecting duct and the heating portion faces the freezer compartment.

The thermoelement may be disposed adjacent to the ice-making chamber such that the cooling portion faces the ice-making chamber and the heating portion faces the connecting duct.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, the exemplary embodiments of the present disclosure will be described in detail.

Figure 1:
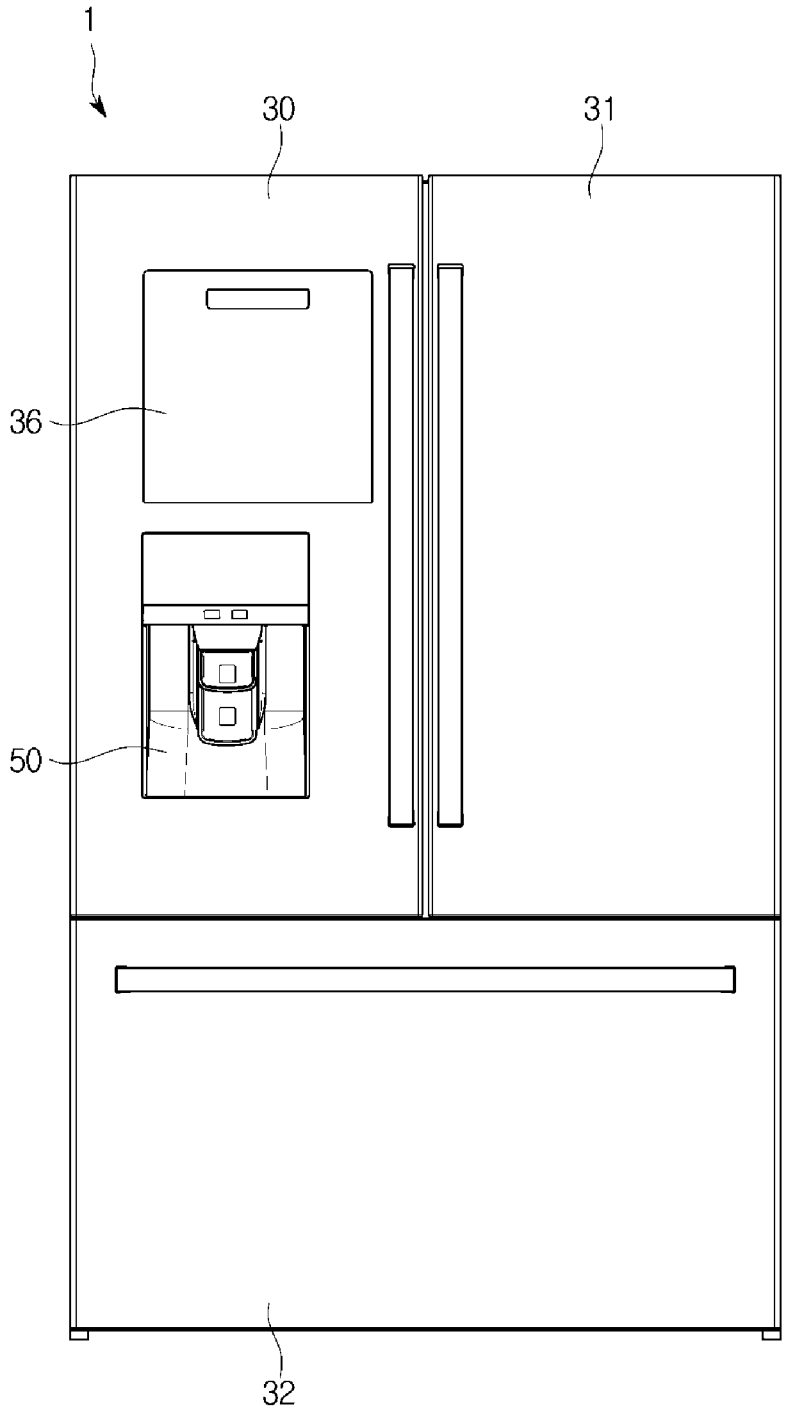
FIG. 1 illustrates a view illustrating a front surface of a refrigerator according to one embodiment of the present disclosure.
Figure 2:
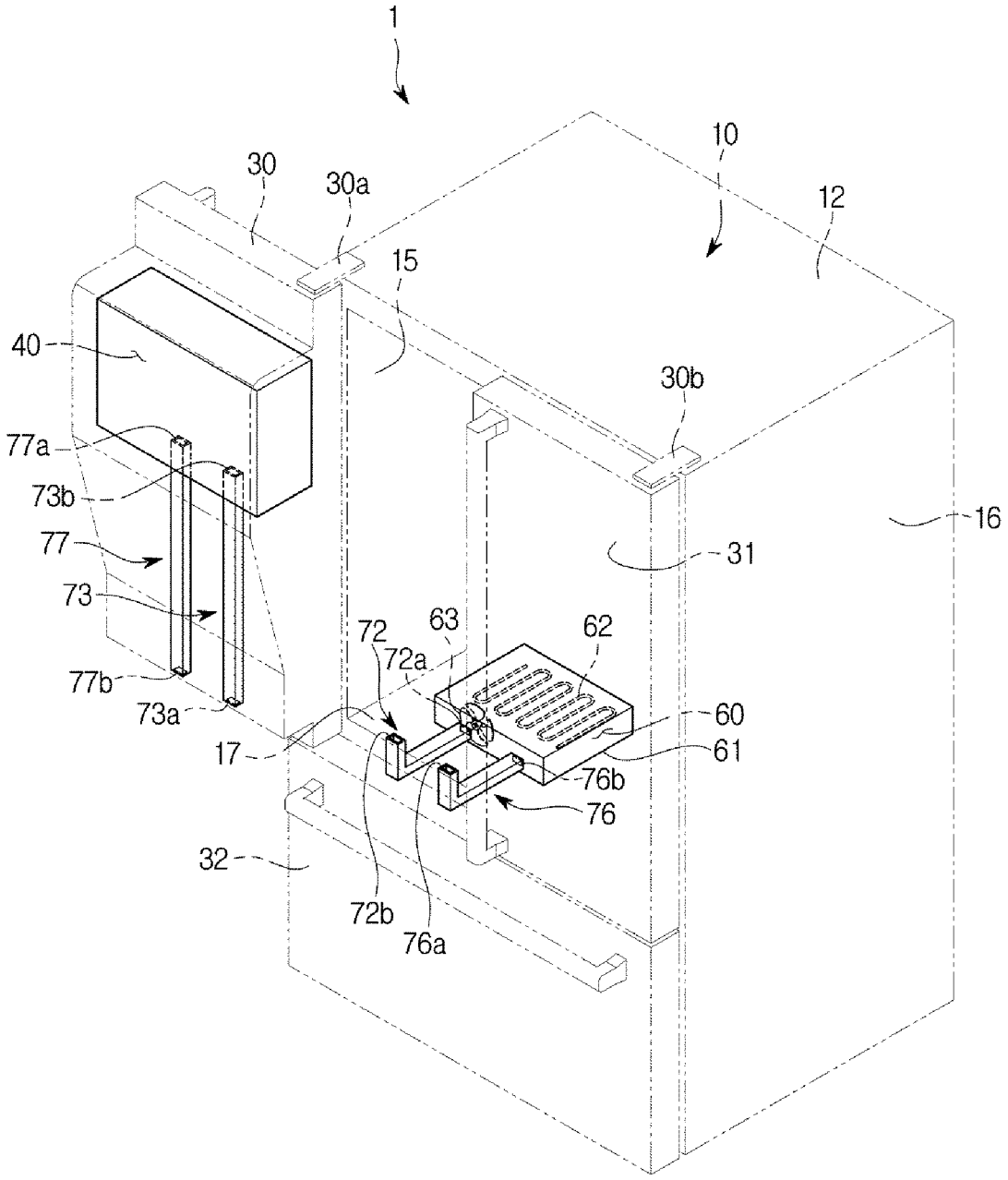
FIG. 2 illustrates a schematic perspective view illustrating main components of the refrigerator of FIG. 1.
Figure 3:
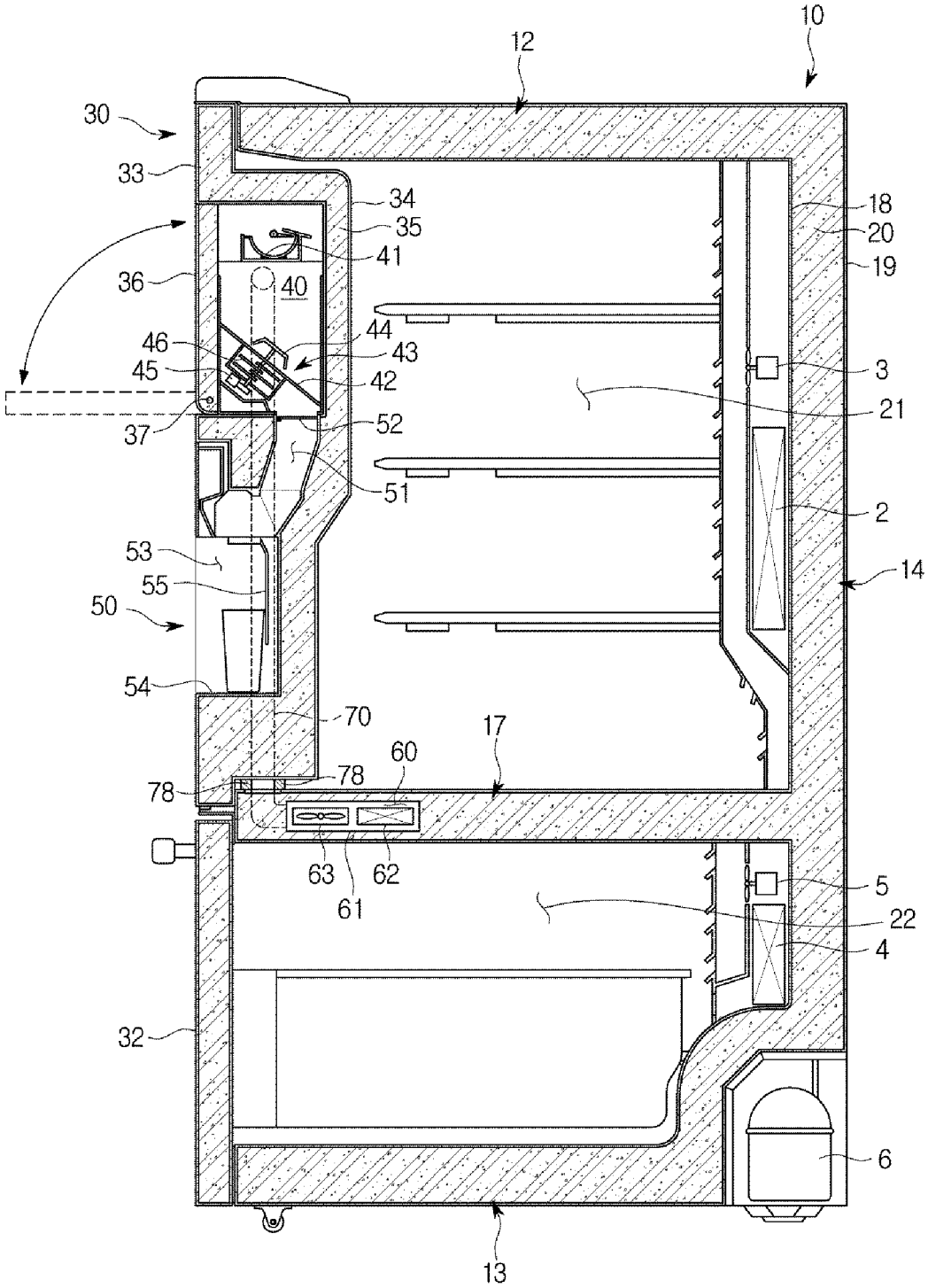
FIG. 3 illustrates a schematic side cross-sectional view illustrating the main components of the refrigerator of FIG. 1.

FIG. 1 illustrates a view illustrating a front surface of a refrigerator according to one embodiment of the present disclosure, FIG. 2 illustrates a schematic perspective view illustrating main components of the refrigerator of FIG. 1, and FIG. 3 illustrates a schematic side cross-sectional view illustrating the main components of the refrigerator of FIG. 1.

Referring to FIGS. 1 to 3, a refrigerator 1 may include a main body 10 having a wall and refrigerator and freezer compartments 21 and 22, doors 30 and 31 rotatably provided to open and close the refrigerator and freezer compartment 21, and a door 32 slidably provided to open and close the freezer compartment 22. An ice-making chamber 40 may be formed at a front surface of the door 30 and configured to make and store ice.

The wall may include an inner box 18, an outer box 19 coupled to an outer side of the inner box 18, and an insulation 20 provided between the inner box 18 and the outer box 19. The inner box 18 may be formed of a plastic material by injection-molding, and the refrigerator and freezer compartments 21 and 22 may be formed by the inner box 18. The outer box 19 may be formed of a metal material. A urethane foam insulation may be used as the insulation 20, and a vacuum insulation panel and the urethane foam insulation may be used as the insulation 20 as necessary. The urethane foam insulation may be formed by coupling the inner box 18 and the outer box 19, filling a space between the inner box 18 and the outer box 19 with urethane foam in which urethane and a foaming agent are mixed, and foaming the urethane foam. Since the urethane foam has a high adhesive force, a coupling force between the inner box 18 and the outer box 19 may be increased, and when foaming is completed, a sufficient strength may be secured.

From another perspective, the wall may include an upper wall 12, a bottom wall 13, a rear wall 14, a left side wall 15, a right side wall 16, and an intermediate wall 17. The intermediate wall 17 may substantially horizontally extend between the upper wall 12 and the bottom wall 13, and the refrigerator and freezer compartments 21 and 22 may be divided into the upper refrigerator compartment 21 and the lower freezer compartment 22. The refrigerator compartment 21 may be maintained at a temperature of about 0 to 5 degrees Celsius and may store food under refrigeration, and the freezer compartment 22 may be maintained at a temperature of about minus 30 to 0 degrees Celsius and may store food frozen.

The doors 30 and 31 may be rotatably coupled to the main body 10 by hinge members 30*a* and 30*b* in right and left directions. The door 30 may include a door front plate 33, a door rear plate 34, and an insulation 35 provided between the door front plate 33 and the door rear plate 34. The urethane foam insulation may be used as the insulation 35 like the insulation 20 of the main body 10, and the vacuum insulation panel and the urethane foam insulation may be used as the insulation 35 as necessary.

The ice-making chamber 40 may be formed by recessing a part of the door front plate 33. Accordingly, the ice-making chamber 40 may be separated and insulated from the refrigerator compartment 21 of the main body 10 by the insulation 35.

The ice-making chamber 40 may be formed to have an open front surface, and the open front surface of the ice-making chamber 40 may be opened or closed by an auxiliary door 36. The auxiliary door 36 may be rotatably coupled to the door 30. The auxiliary door 36 may be provided to be vertically rotatable about a hinge shaft 37.

An ice maker 41 configured to make ice by freezing water using cooling air of the ice-making chamber 40, and an ice bucket 42 configured to store the ice made by the ice maker 41 may be disposed in the ice-making chamber 40. The ice bucket 42 may include a mover 43 configured to transfer stored ice to a dispenser 50, which will be described below, and an ice crushing blade 46 configured to crush ice. The mover 43 may include a moving motor 45 and a moving member 44 configured to stir or transfer ice using a rotational force of the moving motor 45 while rotating.

With the above structure, even in a state in which the door 30 is closed, the ice-making chamber 40 can be accessible by opening only the auxiliary door 36, the ice bucket 42 can be withdrawn from the ice-making chamber 40, and the ice maker 41 and the ice bucket 42 can be repaired or replaced. In addition, since a state in which the door 30 is closed is maintained when the main ice-making chamber 40 is accessed, cooling air of the refrigerator compartment 21 cannot leak.

The dispenser 50 configured to supply ice to an outside of the door 30 may be provided below the ice-making chamber 40. The dispenser 50 may include a dispensing space 53 formed to be recessed to receive ice, a dispensing tray 54 on which a container, such as a cup, may be put in the dispensing space 53, a chute 51 configured to connect a discharging hole of the ice bucket 42 and the dispensing space 53, an opening and closing member 52 configured to normally close the chute 51 to prevent leakage of cooling air of the ice-making chamber 40 through the chute 51 and open the chute 51 such that ice passes through the chute 51 when the dispenser operates, and a switch 55 from which an operation command of the dispenser may be input.

The refrigerator 1 includes a cooler configured to generate cooling air to supply the cooling air to the refrigerator compartment 21, a freezer compartment 22, and the ice-making chamber 40. The cooler may include a refrigerator compartment vaporizer 2, a freezer compartment vaporizer 4, and an ice-making chamber vaporizer 62. The refrigerator compartment vaporizer 2, the freezer compartment vaporizer 4, and the ice-making chamber vaporizer 62 may be connected to a compressor 6, a condenser (not shown), and an expender (not shown), and cooling air may be generated using evaporation latent heat of a refrigerant.

Cooling air generated by the refrigerator compartment vaporizer 2 may be supplied to the refrigerator compartment 21 by a refrigerator compartment blower fan 3, cooling air generated by the freezer compartment vaporizer 4 may be supplied to the freezer compartment 22 by a freezer compartment blower fan 5, and cooling air generated by the ice-making chamber vaporizer 62 may be supplied to the ice-making chamber 40 by an ice-making chamber blower fan 63.

The refrigerator compartment vaporizer 2 and the refrigerator compartment blower fan 3 may be disposed behind the refrigerator compartment 21, and the freezer compartment vaporizer 4 and the freezer compartment blower fan 5 may be disposed behind the freezer compartment 22. The ice-making chamber vaporizer 62 and the ice-making chamber blower fan 63 may be disposed in a cooling chamber 60 provided inside the intermediate wall 17.

The cooling chamber 60 may be formed inside a cooling chamber case 61, and the cooling chamber case 61 may be installed to be buried in the insulation 20 of the intermediate wall 17. The cooling chamber case 61 may have substantially a hollow hexahedral shape, and may have a thickness less than that of the intermediate wall 17. As described above, since the cooling chamber 60 configured to cool the ice-making chamber 40 is provided inside the intermediate wall 17 of the main body, space reduction of the refrigerator and freezer compartments 21 and 22 can be minimized and space utilization can be improved.

The refrigerator 1 includes a cooling air duct 70 configured to connect the ice-making chamber 40 and the cooling chamber 60 to supply cooling air generated in the cooling chamber 60 to the ice-making chamber 40. Since the ice-making chamber 40 is provided in the door 30 and the cooling chamber 60 is provided in the main body 10, the cooling air duct 70 may be provided such that the ice-making chamber 40 and the cooling chamber 60 are connected when the door 30 is closed and the ice-making chamber 40 and the cooling chamber 60 are separated from each other when the door 30 is opened.

The cooling air duct 70 may include supply ducts 72 and 73 provided to supply cooling air of the cooling chamber 60 to the ice-making chamber 40, and collecting ducts 77 and 76 provided such that the cooling chamber 60 collects air of the ice-making chamber 40, and may guide the air to circulate between the ice-making chamber 40 and the cooling chamber 60.

The supply ducts 72 and 73 may include the main body supply duct 72 provided in the main body 10, and the door supply duct 73 provided in the door 30. An inlet 72*a* of the main body supply duct 72 may be connected to the cooling chamber 60, an outlet 73*b* of the door supply duct 73 may be connected to the ice-making chamber 40, and an outlet 72*b* of the main body supply duct 72 and an inlet 73*a* of the door supply duct 73 may be provided to be connected to each other when the door 30 is closed.

The collecting ducts 76 and 77 may include the main body collecting duct 76 provided in the main body 10 and the door collecting duct 77 provided in the door 30. An inlet 77*a* of the door collecting duct 77 may be connected to the ice-making chamber 40, an outlet 76*b* of the main body collecting duct 76 may be connected to the cooling chamber 60, and an outlet 77*b* of the door collecting duct 77 and an inlet 76*a* of the main body collecting duct 76 may be provided to be connected to each other when the door 30 is closed.

Sealing members 78 configured to maintain sealing of a connecting portion between the main body supply duct 72 and the door supply duct 73 and sealing of a connecting portion between the main body collecting duct 76 and the door collecting duct 77 in a state in which the door 30 is closed may be provided in the door 30.

In the present embodiment, although the cooling air duct 70 passes through the intermediate wall 17, the cooling air duct 70 may also be provided to pass through the left and right side walls 15 and 16 or the upper wall 12.

With the above structure, since the ice-making chamber 40 is independently separated from the refrigerator compartment 21 and the freezer compartment 22, and the cooling air duct 70 directly connects the ice-making chamber 40 and the cooling chamber 60 without passing through the refrigerator compartment 21 and the freezer compartment 22, odors of food stored in the refrigerator compartment 21 and the freezer compartment 22 are not introduced into the ice-making chamber 40, a temperature and a humidity of the ice-making chamber 40 may be maintained independently of the refrigerator compartment 21 and the freezer compartment 22.

Figure 4:
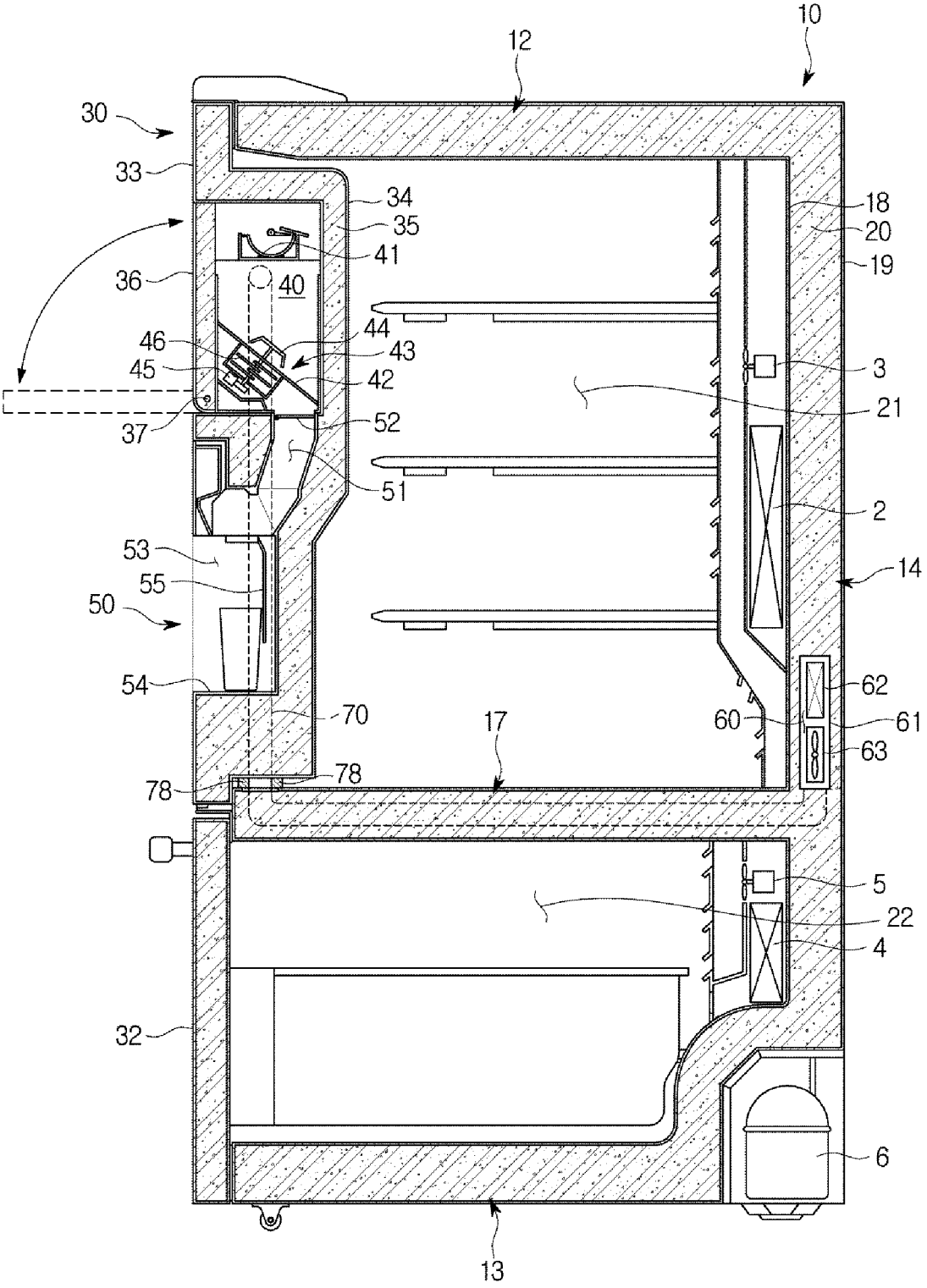
FIGS. 4 to 6 illustrate views of refrigerators according to another embodiment of the present disclosure in which cooling chambers configured to cool an ice-making chamber are provided in a rear wall, an upper wall, and a left side wall of main bodies.
Figure 5:
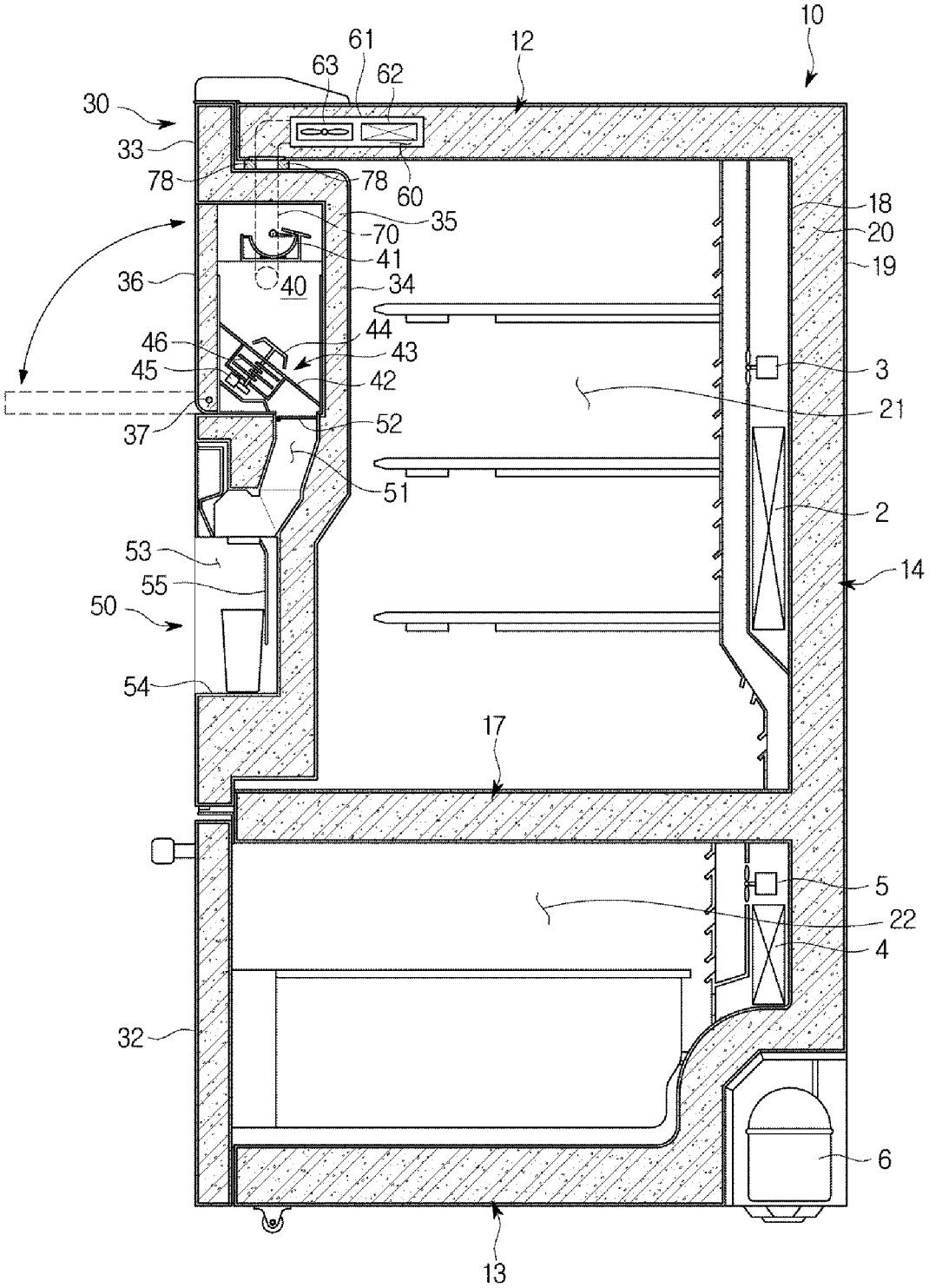
Figure 6:
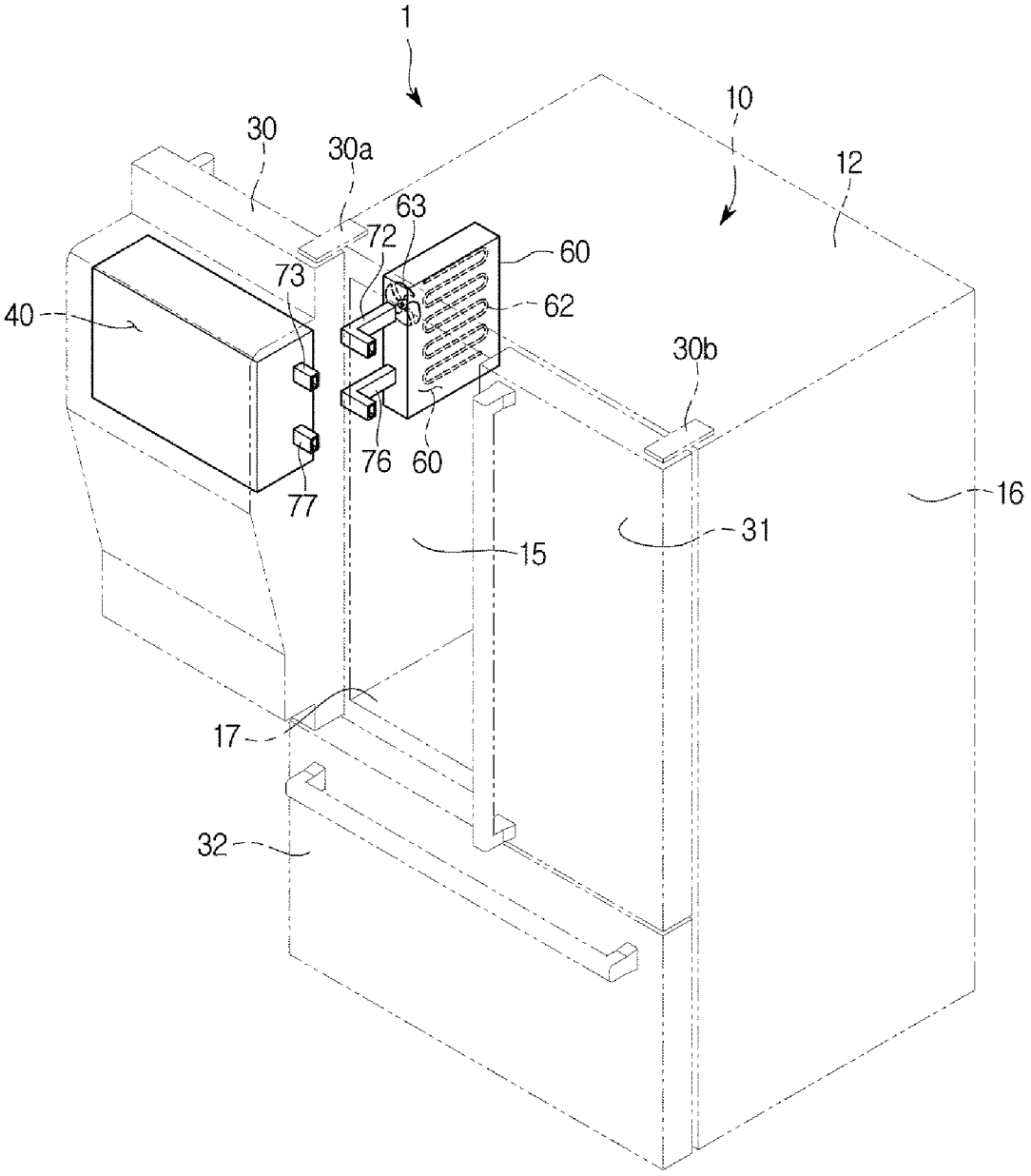

FIGS. 4 to 6 illustrate views of refrigerators according to another embodiment of the present disclosure in which cooling chambers configured to cool an ice-making chamber are provided in a rear wall, an upper wall, and a left side wall of main bodies.

The refrigerators according to another embodiment of the present disclosure will be described with reference to FIGS. 4 to 6. The same reference numerals in the drawings denote the same elements as those of the above-described embodiment, and the descriptions thereof may be omitted.

A cooling chamber 60 for supplying cooling air to an ice-making chamber 40 may not be provided inside an intermediate wall 17 of a main body 10, but may be provided inside the other walls of the main body 10. For example, the cooling chamber 60 may be provided inside a rear wall 14 of the main body 10 as illustrated in FIG. 4, the cooling chamber 60 may be provided inside an upper wall 12 of the main body 10 as illustrated in FIG. 5, and the cooling chamber 60 may be provided inside a left side wall 15 or right side wall 16 of the main body 10 as illustrated in FIG. 6.

Figure 7:
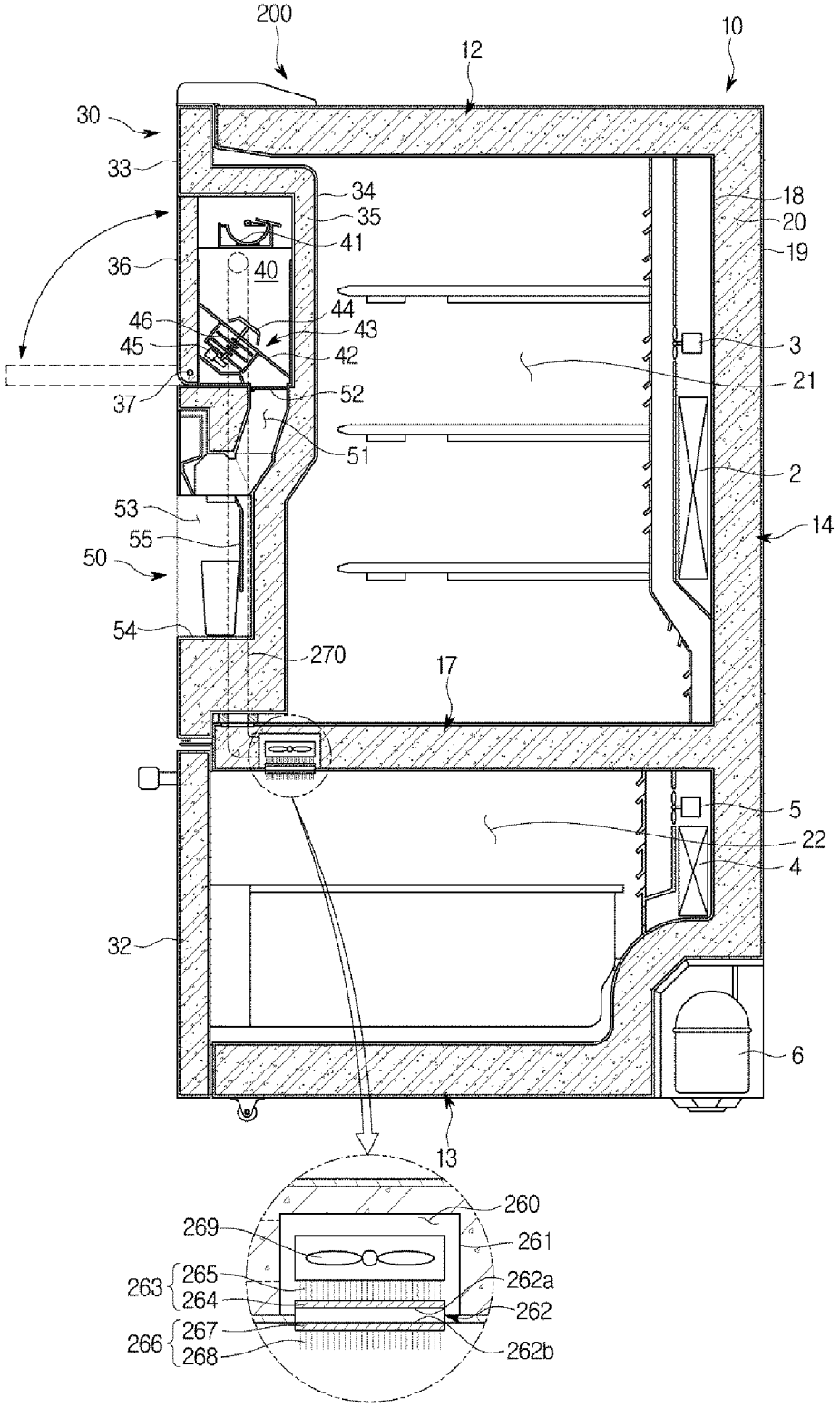
FIGS. 7 to 8 illustrates views of a refrigerator according to still another embodiment of the present disclosure in which a thermoelement is used as a cooler for cooling an ice-making chamber.
Figure 8:
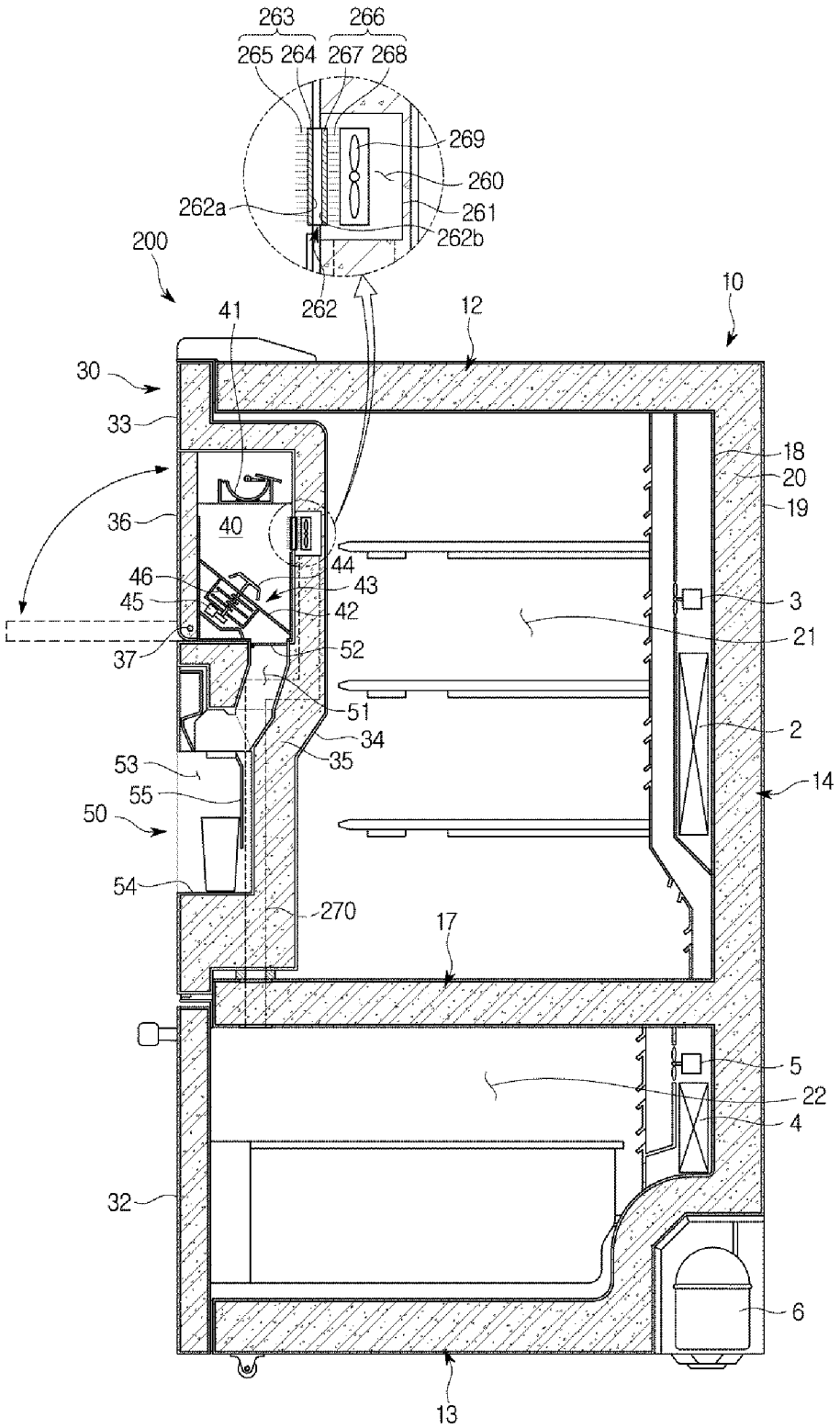

FIGS. 7 to 8 illustrate views of a refrigerator according to still another embodiment of the present disclosure in which a thermoelement is used as a cooler for cooling an ice-making chamber.

An example in which a thermoelement is disposed adjacent to a freezer compartment is illustrated in FIG. 7, and an example in which the thermoelement is disposed adjacent to an ice-making chamber is illustrated in FIG. 8.

A refrigerator 200 according to still another embodiment of the present disclosure will be described with reference to FIG. 7. The same reference numerals in the drawings denote the same elements as those of the above-described embodiment, and the descriptions thereof may be omitted.

Unlike the vaporizer of the above-described embodiment, a thermoelement 262 may be used as a cooler configured to generate cooling air for supplying the cooling air to an ice-making chamber 40.

The thermoelement 262 includes a cooling portion 262*a* formed on one surface thereof to absorb heat and a heating portion 262*b* formed on the opposite surface thereof to dissipate heat, the cooling portion 262*a* absorbs heat, and the heating portion 262*b* dissipates the heat according to the Peltier effect.

The refrigerator 200 may include a connecting duct (260 and 270) configured to connect an ice-making chamber 40 and a freezer compartment 22, and the thermoelement 262 may be disposed in the connecting duct (260 and 270).

The connecting duct (260 and 270) may include a cooling chamber 260 formed such that one surface of the cooling chamber 260 in an intermediate wall 17 of a main body 10 is in contact with a freezer compartment 22, and a cooling air duct 270 configured to connect the cooling chamber 260 and the ice-making chamber 40. The cooling chamber 260 may be formed inside a cooling chamber case 261, and the cooling chamber case 261 may be installed to be buried in an insulation 20.

The thermoelement 262 may be disposed adjacent to the freezer compartment 22 such that the cooling portion 262*a* faces the connecting duct (260 and 270), and the heating portion 262*b* faces the freezer compartment 22. A blower fan 269 may be formed such that cooling air generated by the cooling portion 262*a* of the thermoelement 262 flows to the ice-making chamber 40 through the connecting duct (260 and 270).

A cooling portion heat transfer member 263 may be attached to the cooling portion 262*a*, and a heating portion heat transfer member 266 may be attached to the heating portion 262*b*. The cooling portion heat transfer member 263 may include a base 264 in surface contact with the cooling portion 262*a* and a thermal exchange pin 265, and the heating portion heat transfer member 266 may include a base 267 in surface contact with the heating portion 262*b*, and a thermal exchange pin 268.

With the above structure, since the thermoelement 262 absorbs heat of the ice-making chamber 40 and dissipates the heat to the freezer compartment 22, the thermoelement 262 can cool the ice-making chamber 40. Since a temperature of the freezer compartment 22 is generally maintained at a temperature of a refrigerator compartment 21 or at a temperature less than room temperature, heat of the heating portion 262*b* of the thermoelement 262 is dissipated to the freezer compartment 22 rather than an outside of the refrigerator compartment 21 or the refrigerator, a temperature difference between the cooling portion 262*a* and the heating portion 262*b* of the thermoelement 262 decreases, and thus cooling efficiency of the ice-making chamber 40 may be improved.

As illustrated in FIG. 8, the thermoelement 262 may also be disposed adjacent to the ice-making chamber 40.

The refrigerator 200 may include the connecting duct (260 and 270) configured to connect the ice-making chamber 40 and the freezer compartment 22, and the thermoelement 262 may be disposed in the connecting duct (260 and 270).

The connecting duct (260 and 270) may include a cooling chamber 260 formed such that one surface of the cooling chamber 260 inside a door 30 is connected to the ice-making chamber 40, and a cooling air duct 270 configured to connect the cooling chamber 260 and the freezer compartment 22. The cooling chamber 260 is formed inside the cooling chamber case 261, and the cooling chamber case 261 may be installed to be buried in the insulation 35 of the door 30.

The thermoelement 262 may be disposed adjacent to the ice-making chamber 40 such that the cooling portion 262*a* faces the ice-making chamber 40 and the heating portion 262*b* faces to the connecting duct (260 and 270). The blower fan 269 may be provided such that air flows to dissipate heat of the heating portion 262*b* of the thermoelement 262 to the freezer compartment 22.

Figure 9:
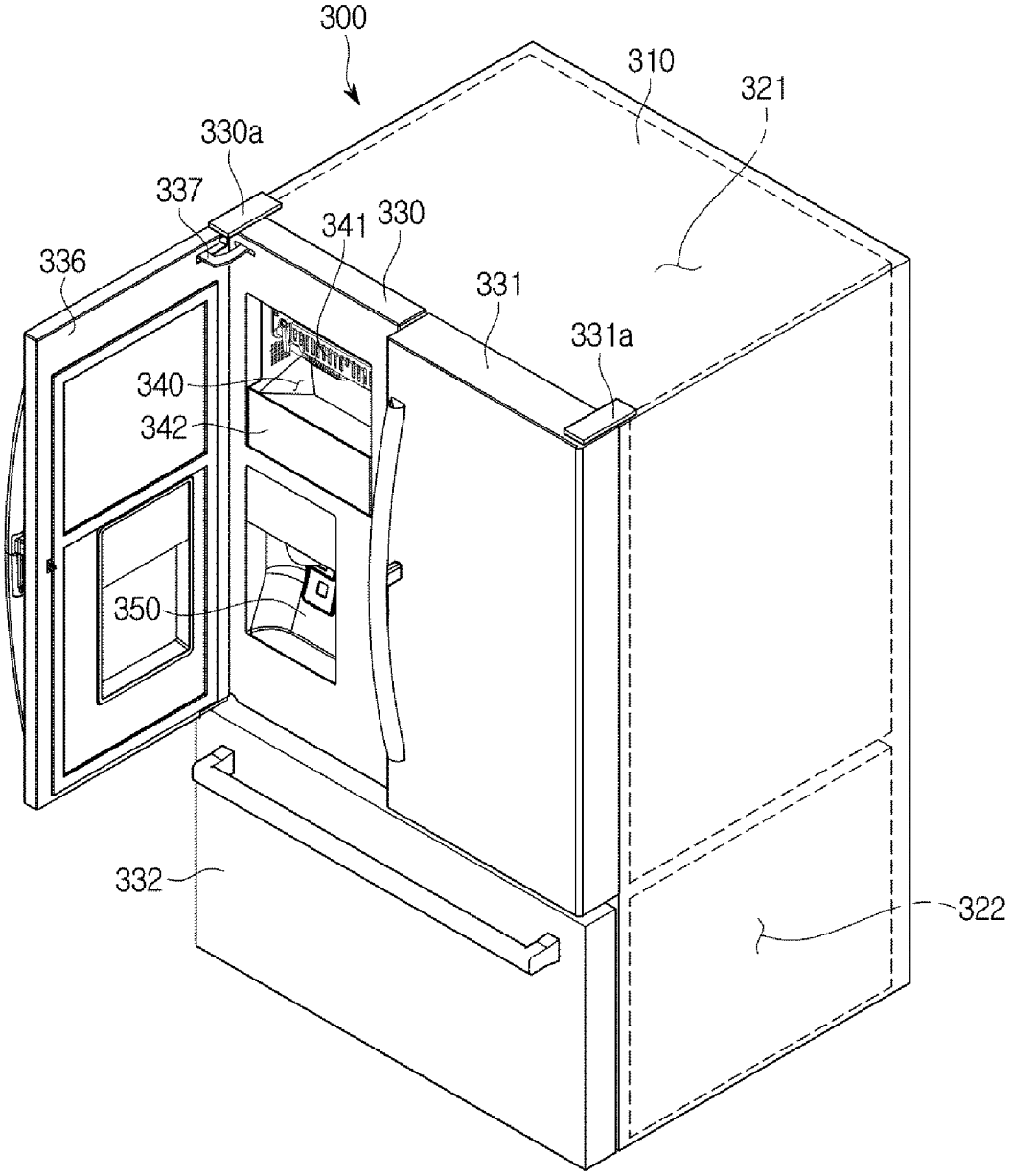
FIG. 9 illustrates a view of a refrigerator according to yet another embodiment of the present disclosure provided such that an auxiliary door is rotatable in the same rotational direction as a door and covers an entire front surface of the door.

FIG. 9 illustrates a view of a refrigerator according to yet another embodiment of the present disclosure provided such that an auxiliary door is rotatable in the same rotational direction as a door and covers an entire front surface of the door.

The refrigerator according to yet another embodiment of the present disclosure will be described with reference to FIG. 9. The same reference numerals in the drawings denote the same elements as those of the above-described embodiment, and the descriptions thereof may be omitted.

Unlike the above-described embodiment, an auxiliary door 336 may be provided to rotate in the same as a rotational direction of a door 330, and cover an entire front surface of the door 330.

A refrigerator 300 may include a main body 310 having a refrigerator compartment 321 and a freezer compartment 322, a pair of doors 330 and 331 rotatably provided to open and close the refrigerator compartment 321, and a door 332 slidably provided to open and close the freezer compartment 322.

An ice-making chamber 340 configured to make and store ice may be formed in the front surface of the door 330. An ice maker 341 configured to make ice, and an ice bucket 342 configured to store the ice may be disposed in the ice-making chamber 340. A dispenser 350 configured to supply to the outside may be provided in the door 330.

The doors 330 and 331 may be rotatably coupled to the main body 310 in left and right directions by hinge members 330*a* and 331*a*. The refrigerator 300 may include an auxiliary door 336 provided to open and close the ice-making chamber 340. The auxiliary door 336 may be rotatably provided in a left-right direction which is the same direction as a rotational direction of the door 330, and may have a size to cover the entire front surface of the door 330. The auxiliary door 336 may be rotatably coupled to the door 330 or the main body 310 by a hinge member 337.

As is apparent from the above description, since an ice-making chamber is formed in a front surface of a door, an ice maker and an ice bucket disposed in the ice-making chamber can be easily accessed without opening a door.

Ice can be easily withdrawn, and an ice maker and an ice bucket can be easily repaired and replaced.

Since a state in which a door is closed is maintained when an ice-making chamber is accessed, cooling air of a storage compartment cannot leak.

Since an ice-making chamber is formed in a front surface of a door and a cooler configured to cool the ice-making chamber is provided inside a partition wall of a main body, space utilization of the storage compartment can be improved.

Since an ice-making chamber and a storage compartment configured to store food are formed to be separated from each other and cooling air is supplied to the ice-making chamber and the storage compartment through independent routes, cooling air cannot flow between the ice-making chamber and the storage compartment, and thus odors of the storage compartment cannot be transferred to the ice-making chamber.

Since a thermoelement is provided such that heat of an ice-making chamber is not dissipated to an outside of a refrigerator, which is at room temperature, or a refrigerator compartment but is dissipated to a freezer compartment having a relatively low temperature, ice making efficiency can be improved.

Although the technical sprit of the present disclosure has been described with reference to specific embodiments, the scope of the present disclosure is not limited to the above-described specific embodiments. Various other embodiments that may be changed or modified by those skilled in the art without departing from the scope and spirit of the present disclosure defined by the appended claims fall within the scope of the present disclosure.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body including a refrigerator compartment and a freezer compartment;

a refrigerator compartment door configured to open and close the refrigerator compartment;

a freezer compartment door configured to open and close the freezer compartment;

an ice-making chamber provided in a front surface of the refrigerator compartment door and separated from the refrigerator compartment by an insulation provided in the refrigerator compartment door;

a cooling chamber having a cooler configured to generate cooling air;

a cooling air duct configured to connect the ice-making chamber and the cooling chamber to supply the cooling air generated by the cooler to the ice-making chamber and to collect air of the ice-making chamber;

an ice-making chamber door provided in the front surface of the refrigerator compartment door and configured to open and close the ice-making chamber; and a dispenser provided in the front surface of the refrigerator compartment door and below the ice-making chamber door;

wherein the ice-making chamber is accessible by opening the ice-making chamber door in a state that the refrigerator compartment door is closed; and wherein the ice-making chamber door is disposed in a portion of the front surface of the refrigerator compartment door above the dispenser.

2. The refrigerator of claim 1, wherein the main body includes an upper wall, a bottom wall, a rear wall, a left side wall, a right side wall, and an intermediate wall provided between the upper wall and the bottom wall.

3. The refrigerator of claim 2, wherein the cooling chamber is provided inside one of the intermediate wall, the rear wall, the upper wall, the left side wall, and the right side wall.

4. The refrigerator of claim 1, further comprising:

a refrigerator compartment cooler configured to cool the refrigerator compartment; and a freezer compartment cooler configured to cool the freezer compartment, wherein the ice-making chamber is cooled independently of the refrigerator compartment and the freezer compartment.

5. The refrigerator of claim 1, further comprising:

an inner box, an outer box, and a second insulation provided between the inner box and the outer box; and a cooling chamber case buried in the second insulation and having the cooling chamber formed thereinside.

6. The refrigerator of claim 1, wherein the ice-making chamber door is rotatably coupled to the refrigerator compartment door in a direction different from a rotational direction of the refrigerator compartment door.

7. The refrigerator of claim 1, wherein the cooling air duct includes a supply duct configured to supply the cooling air of the cooling chamber to the ice-making chamber, and a collecting duct configured to collect the air of the ice-making chamber in the cooling chamber.

8. The refrigerator of claim 7, wherein:

the supply duct includes a main body supply duct provided in the main body and a door supply duct provided in the refrigerator compartment door; and the main body supply duct and the door supply duct are connected to each other when the refrigerator compartment door is closed and separated from each other when the refrigerator compartment door is opened.

9. The refrigerator of claim 8, wherein:

an inlet of the main body supply duct is connected to the cooling chamber;

an outlet of the door supply duct is connected to the ice-making chamber; and an outlet of the main body supply duct and an inlet of the door supply duct are connected to each other when the refrigerator compartment door is closed.

10. The refrigerator of claim 7, wherein:

the collecting duct includes a main body collecting duct provided in the main body and a door collecting duct provided in the refrigerator compartment door; and the main body collecting duct and the door collecting duct are connected to each other when the refrigerator compartment door is closed and separated from each other when the refrigerator compartment door is opened.

11. The refrigerator of claim 10, wherein:

an inlet of the door collecting duct is connected to the ice-making chamber;

an outlet of the main body collecting duct is connected to the cooling chamber; and an outlet of the door collecting duct and an inlet of the main body collecting duct are connected to each other when the refrigerator compartment door is closed.

12. The refrigerator of claim 1, further comprising:

an ice maker disposed in the ice-making chamber and configured to make ice; and an ice bucket disposed in the ice-making chamber and configured to store the ice generated by the ice maker.

13. The refrigerator of claim 12, wherein:

the dispenser is configured to supply ice stored in the ice bucket to an outside area; and the ice bucket includes a mover configured to transfer ice to the dispenser.

14. The refrigerator of claim 1, wherein the cooler includes at least one of a vaporizer or a thermoelement.

15. The refrigerator of claim 1, further comprising:

a blower fan configured to move the cooling air of the cooling chamber to the ice-making chamber through the cooling air duct.

* * * * *